US011800921B2

(12) United States Patent
Liu

(10) Patent No.: US 11,800,921 B2
(45) Date of Patent: Oct. 31, 2023

(54) LIPSTICK CONTAINER FOR HOT FILLING WITH REPLACEABLE LIPSTICK ASSEMBLY

(71) Applicant: Ting Nan Liu, New Taipei (TW)

(72) Inventor: Ting Nan Liu, New Taipei (TW)

(73) Assignee: Zhuhai Ding Rong Plastic Products Co., LTD., Zhuhai (CN)

( * ) Notice: Subject to any disclaimer, the term of this patent is extended or adjusted under 35 U.S.C. 154(b) by 193 days.

(21) Appl. No.: 17/541,416

(22) Filed: Dec. 3, 2021

(65) Prior Publication Data

US 2023/0172340 A1 Jun. 8, 2023

(51) Int. Cl.
*A45D 40/06* (2006.01)
*A45D 40/00* (2006.01)

(52) U.S. Cl.
CPC ..... *A45D 40/06* (2013.01); *A45D 40/065* (2013.01); *A45D 2040/0018* (2013.01); *A45D 2040/0043* (2013.01); *A45D 2040/0056* (2013.01)

(58) Field of Classification Search
CPC ..... A45D 40/06; A45D 40/065; A45D 2040/0043; A45D 2040/0062
USPC ..... 401/68, 75
See application file for complete search history.

(56) References Cited

U.S. PATENT DOCUMENTS

| | | | | |
|---|---|---|---|---|
| 7,322,765 | B2 * | 1/2008 | Wang | A45D 40/205 401/172 |
| 11,076,679 | B1 * | 8/2021 | Chung | A45D 40/06 |
| 11,622,613 | B1 * | 4/2023 | Chung | A45D 40/06 401/75 |
| 2023/0052536 | A1 * | 2/2023 | Onoe | A45D 40/12 |

* cited by examiner

*Primary Examiner* — Jennifer C Chiang

(57) ABSTRACT

A lipstick container for hot filling with replaceable lipstick assembly includes a base, a fixed tube, a lipstick assembly and a cap. The lipstick assembly includes a support tube, a sleeving tube, and an ascending and descending tube; the fixed tube includes a first axial channel; the support tube includes a second axial channel; the sleeving tube includes a third axial channel; the ascending and descending tube includes a forth axial channel and a spiral groove portion screwed with internal threads of the support tube. The fixed tube is put on the sleeving tube and the ascending and descending tube is disposed through the sleeving tube and the support tube; an end of the sleeving tube urging against the support tube.

5 Claims, 9 Drawing Sheets

LIPSTICK CONTAINER FOR HOT FILLING WITH REPLACEABLE LIPSTICK ASSEMBLY

FIELD OF THE INVENTION

The invention relates to cosmetic containers and more particularly to a lipstick container for hot filling with replaceable lipstick assembly.

BACKGROUND OF THE INVENTION

Lipsticks are usually made by the following steps. First, hot filling for the lipsticks is poured in molds. Next, when the filling is cooled down forming the lipsticks, the lipsticks are taken out from the molds and placed in lipstick containers. However, if the desired lipsticks are softer or thinner, the lipsticks are tended to break apart easily when filling. Moreover, when the lipsticks are not taken out from the molds or placed in the lipstick containers in a perfect vertical direction, scratches are easily formed on the lipsticks. As a result, taking the lipsticks out of the molds and placing the lipsticks in the lipstick containers are difficult. Besides, the whole lipstick container including the lipstick is disposed after the contained lipstick is consumed. This not only pollutes the environment but also is not eco-friendly.

Thus, the need for improvement still exists.

SUMMARY OF THE INVENTION

It is therefore one object of the invention to provide a lipstick container for hot filling with replaceable lipstick assembly comprising a base including a close end and an annular trough disposed on an inner surface of an open end distal the close end; a fixed tube including a first axial channel disposed through a center of the fixed tube, an annular groove formed at an inner surface of a first end, an annular flange disposed at an outer surface of the first end, and the annular flange of the fixed tube is secured with the annular trough of the base; a lipstick assembly including a support tube, a sleeving tube and an ascending and descending tube; wherein the support tube includes a second axial channel disposed through a center of the support tube, an annular protrusion formed at an outer surface of a first end of the support tube, internal threads formed at an inner surface of the first end, a plurality of ridges formed on the outer surface and at a middle portion of the support tube, and an annular shoulder disposed between the ridges and the annular protrusion, the fixed tube is put on the support tube, the ridges are mounted on the annular groove; wherein the sleeving tube includes a third axial channel disposed through a center of the sleeving tube, a top of the sleeving tube being flat or inclined, a bottom of the sleeving tube being flat, and at least one locking hole formed through the sleeving tube, the fixed tube is put on the sleeving tube, the flat bottom of the sleeving tube urges against the annular shoulder of the support tube, the locking hole receives the annular protrusion of the support tube; wherein the ascending and descending tube includes a fourth axial channel disposed through a center of the ascending and descending tube, a recess formed at a first end, a spiral groove portion communicates with the recess and extends from the recess towards a second end distal the recess, and a plurality of longitudinal ribs are formed on an inner surface of the recess, the ascending and descending tube is disposed through the third axial channel of the sleeving tube and through the second axial channel of the support tube, the spiral groove portion is correspondently screwed with the internal threads of the support tube; and a cap including a close end and an open end, wherein the open end of the cap receives the sleeving tube and is secured to the fixed tube.

A lipstick can be received in the recess and secured by the longitudinal ribs.

The invention has the following advantages and benefits in comparison with the conventional art:

The lipstick assembly is replaceable. When the lipstick is consumed, a user can hold the fixed tube and unscrew the support tube to remove the support tube, the sleeving tube and the ascending and descending tube together, and replace a new one. As a result, the base, the fixed tube, and the cover can be reused. This not only protects the environment but also is eco-friendly with reduced waste.

Suitable for softer and thinner lipstick. The invention is applicable for hot filling the lipstick by placing the lipstick container upwards and downwards. As a result, it is suitable for softer and thinner lipsticks as well. There's no need to fill a lipstick mold first and take the lipstick out later. Thus, there's no need to worry that scratches may be formed easily if the lipstick is not taken out in a perfect vertical direction or the lipstick may easily break apart when filling.

The above and other objects, features and advantages of the invention will become apparent from the following detailed description taken with the accompanying drawings.

DETAILED DESCRIPTION OF THE INVENTION

Figure 1:
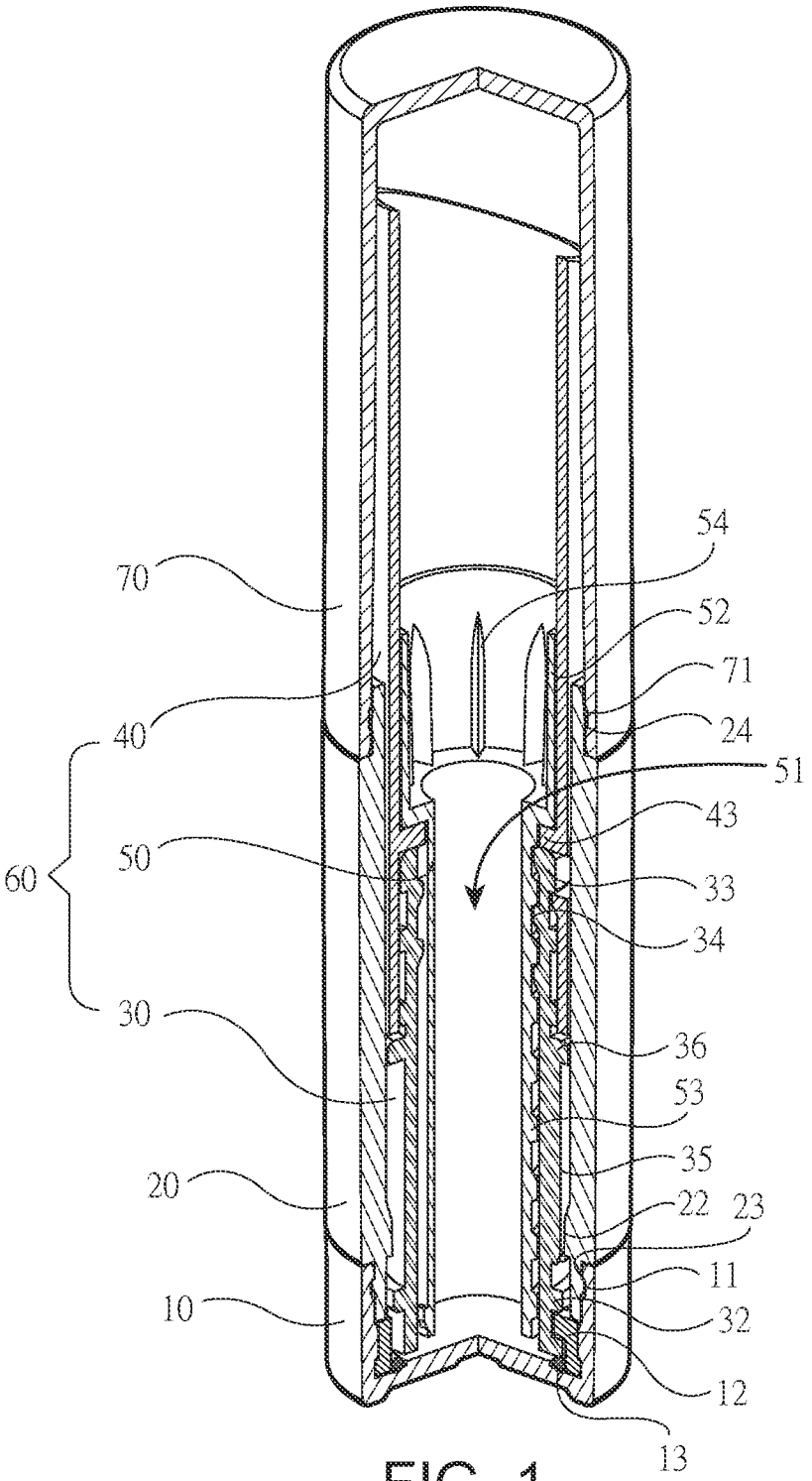
FIG. 1 is a broken away longitudinal sectional view of a lipstick container according to the invention.

Referring to FIG. 1, a lipstick container in accordance with the invention comprises a base 10, a fixed tube 20, a lipstick assembly 60 and a cap 70 as discussed in detail below. The lipstick assembly 60 includes a support tube 30, a sleeving tube 40 and an ascending and descending tube 50. The fixed tube 20 is mounted on the base 10. Next, the support tube 30 is put in the fixed tube 20, so a second end of the support tube 30 urges against the base 10. The sleeving tube 40 is then disposed on a first end of the support tube 30 distal the base 10. Next, the ascending and descending tube 50 is put in the sleeving tube 40 and the support tube 30. Lastly, the cap 70 is put on the sleeving tube 40 and secured to the fixed tube 20.

Figure 2:
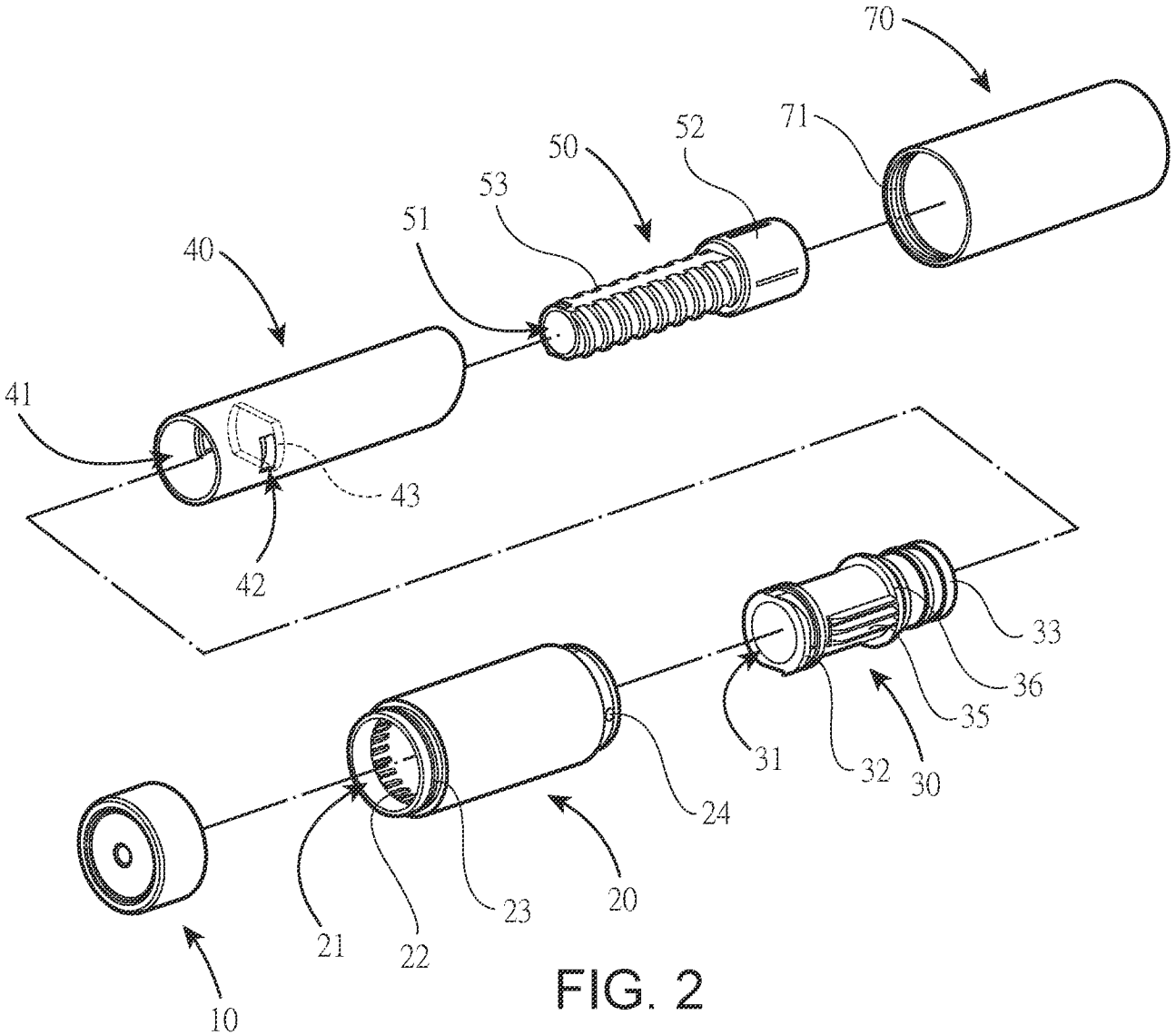
FIG. 2 is a first exploded view of the lipstick container.

Referring to FIG. 2, the base 10 includes a close end. The fixed tube 20 includes a first axial channel 21 disposed through a center of the fixed tube 20 and an annular groove 22 is provided at an inner surface of a first end. An annular flange 23 is disposed on an outer surface of the first end. The support tube 30 includes a second axial channel 31 disposed through a center of the support tube 30. External threads 32 disposed on the support tube 30 adjacent the base 10 are screwed with the base 10. The sleeving tube 40 includes a third axial channel 41 disposed through a center of the sleeving tube 40. A top of the sleeving tube 40 being flat or inclined and a bottom of the sleeving tube 40 being flat. The ascending and descending tube 50 includes a fourth axial channel 51 disposed through a center of the ascending and descending tube 50. A recess 52 forms at a first end of the ascending and descending tube 50 and a spiral groove portion 53 extends from the recess 52 towards a second end distal the recess 52. The spiral groove portion 53 communicates with the recess 52. The cap 70 includes an open end. The open end of the cap 70 further includes an annular slot 71 on an inner surface.

Figure 3:
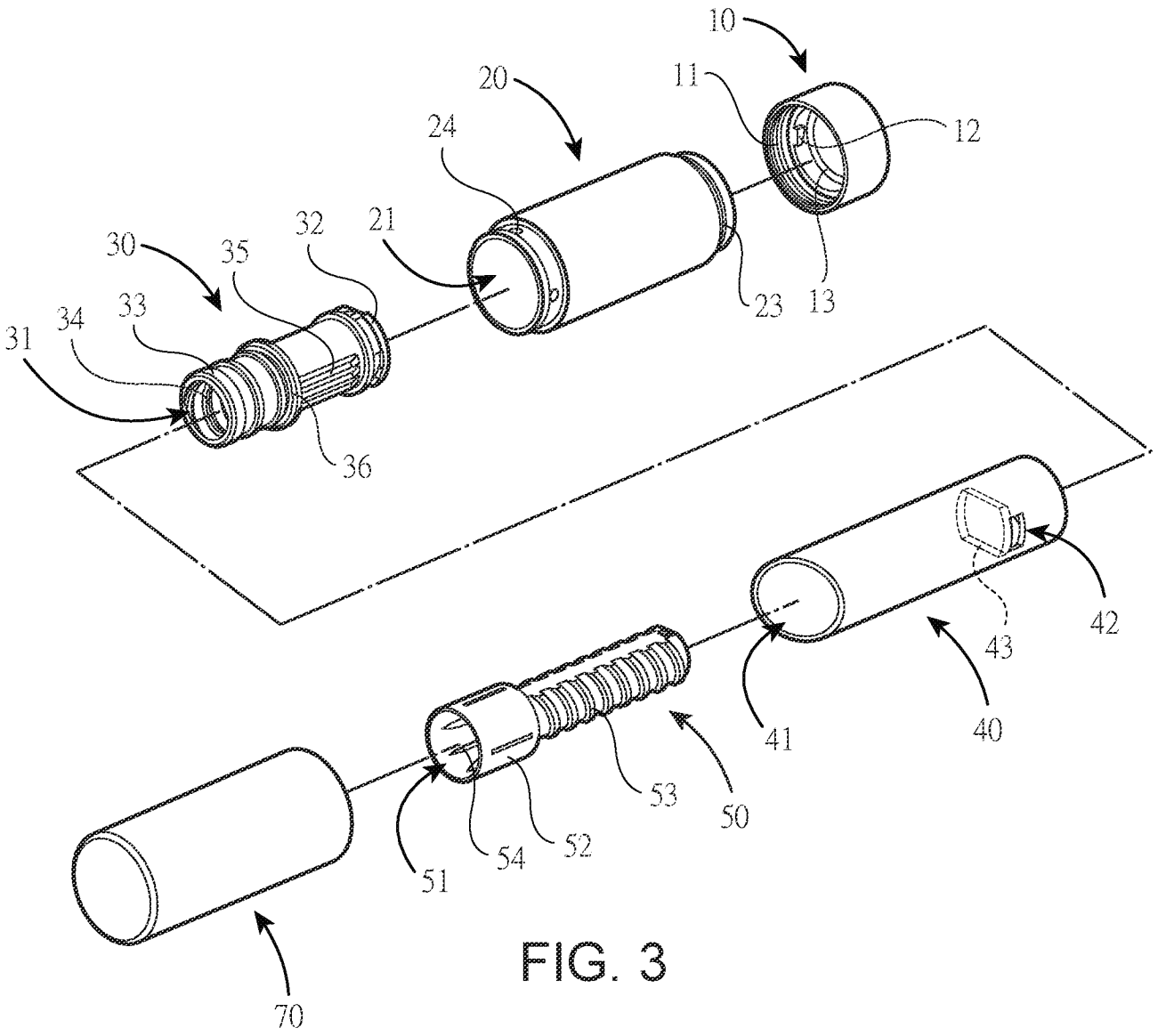
FIG. 3 is a second exploded view of the lipstick container.

Referring to FIG. 3, the base 10 includes an open end and an annular trough 11 disposed on an inner surface of the open end distal the close end. The base 10 further comprises a projecting member 12 and a slip resistant member 13. The fixed tube 20 further comprises a plurality of stubs 24 on the outer surface distal the annular flange 23. An annular protrusion 33 formed on an outer surface of the support tube 30 distal the external threads 32. Internal threads 34 are formed on an inner surface of the first end of the support tube 30. A plurality of ridges 35 are formed on the outer surface and at a middle portion of the support tube 30. An annular shoulder 36 is disposed between the ridges 35 and the annular protrusion 33. At least one locking hole 42 is formed through the sleeving tube 40. The sleeving tube 40 further comprises an annular protuberance 43 circulated along an inner surface of the sleeving tube 40. A plurality of longitudinal ribs 54 are formed on an inner surface of the recess 52. The cap 70 includes a close end at another end.

Referring to FIGS. 1 to 3 again, the projecting member 12 is disposed between an outer surface of the slip resistant member 13 and the inner surface of the base 10. The external threads 32 disposed on the support tube 30 adjacent the base 10 are screwed with the projecting member 12 of the base 10. The annular flange 23 of the fixed tube 20 is secured with the annular trough 11 of the base 10. The fixed tube 20 is put on the support tube 30. The ridges 35 are correspondently mounted on annular grooves 22 of the fixed tube 20. The sleeving tube 35 is put in the fixed tube 20. The flat bottom of the sleeving tube 40 urges against the annular shoulder 36 of the support tube 30. The locking hole 42 receives the annular protrusion 33 of the support tube 30. The ascending and descending tube 50 is disposed through the third axial channel 41 of the sleeving tube 40 and then through the second axial channel 31 of the support tube 30. The annular protuberance 43 urges against an end of the recess 52 which is connected to the spiral groove portion 53. The spiral groove portion 53 is correspondently screwed with the internal threads 34 of the support tube 30. The cap 70 is put on the sleeving tube 40 and secured to the fixed tube 20 by the annular slot 71 snapping the stubs 24.

Figure 5:
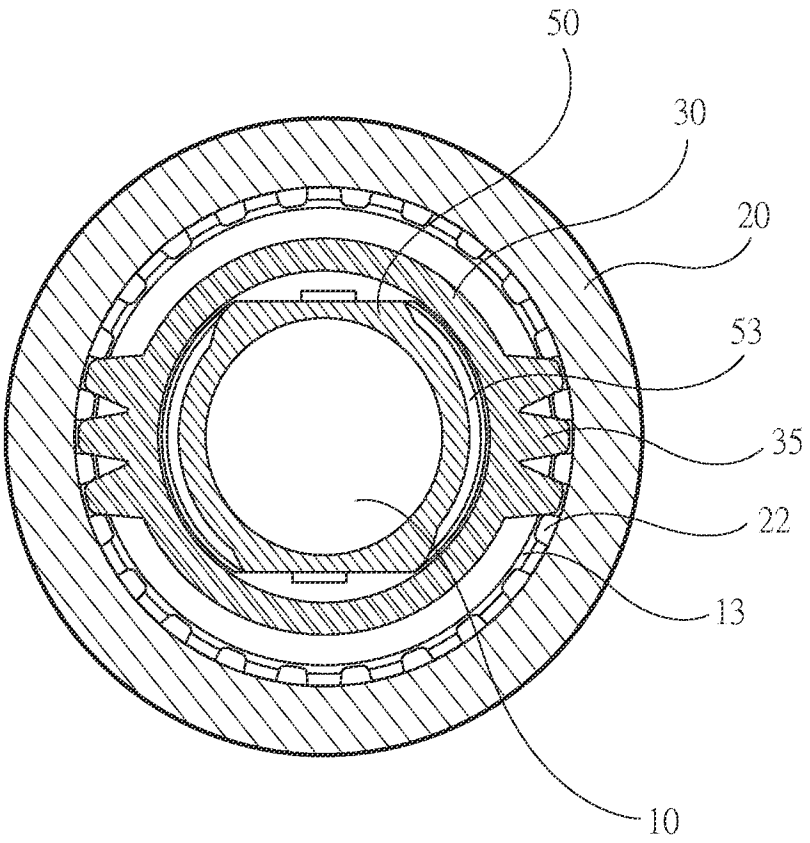
FIG. 5 is a sectional view taken along line 5-5 of FIG. 4
Figure 4:
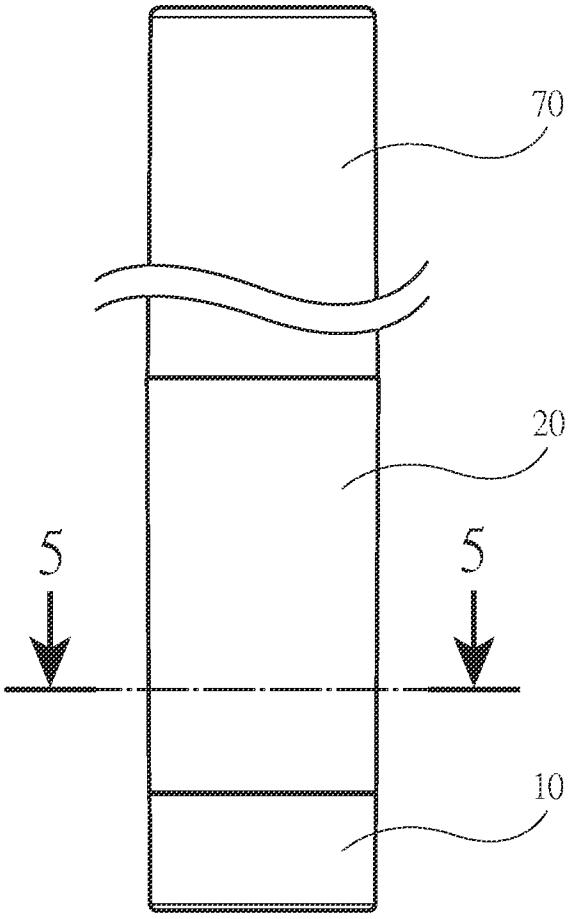
FIG. 4 is a side elevation of the lipstick container.

Referring to FIGS. 4 to 5, the support tube 30 includes three ridges 35 on each side symmetrically disposed on two sides. The annular grooves 22 are disposed on the inner surface of the fixed tube 20 and correspondent to the ridges 35. The ridges 35 are mounted on and secured with the annular groves 22, so the support tube 30 and the fixed tube 20 are secured.

Figure 7:
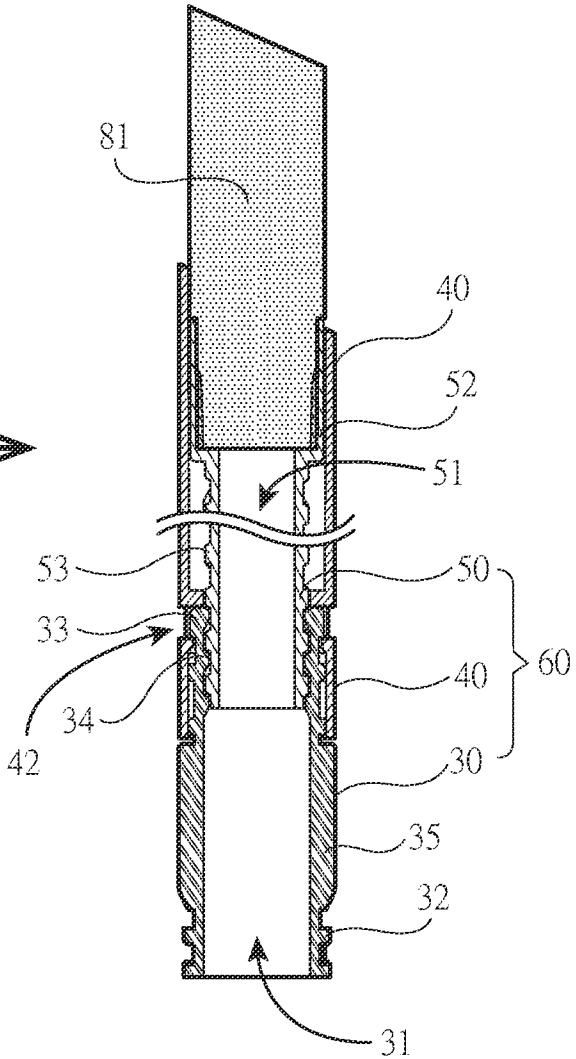
FIG. 7 schematically depicts the premade lipstick mounted on the lipstick assembly.
Figure 6:
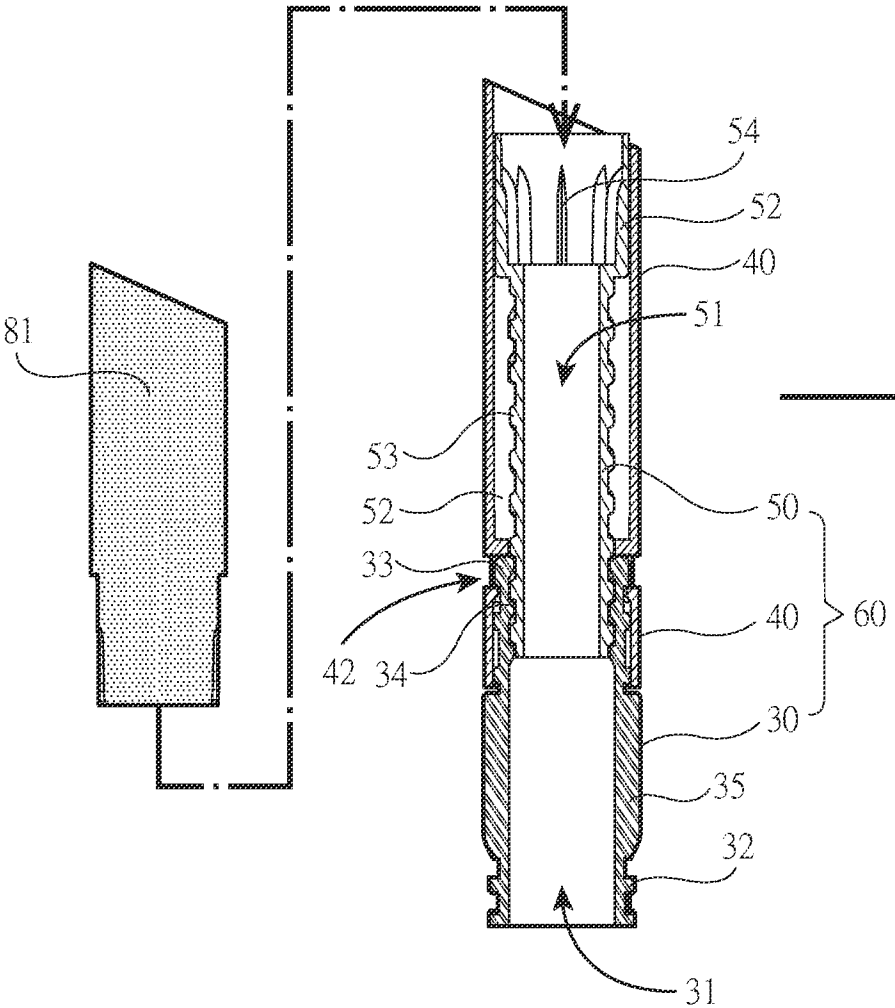
FIG. 6 schematically depicts a premade lipstick and the lipstick assembly.

Referring to FIGS. 6 to 7 and in conjugation with FIGS. 1 to 3, a premade lipstick 81 is mounted on the lipstick assembly 60. The premade lipstick 81 is premade by hot filling a mold and then taken out after cooling down. Next, hold and rotate the fixed tube 20. The spiral groove portion 53 of the ascending and descending tube 50 rotates along the internal threads 34 of the support tube 30 towards the top of the sleeving tube 40, such that the ascending and descending tube 50 rotates towards the top of the sleeving tube 40. The recess 52 of the ascending and descending tube 50 receives the premade lipstick 81 by mounting the premade lipstick 81 onto the longitudinal ribs 54. The hot filling is not limited to only making the premade lipstick 81, and can be applied to other paste.

Figure 9:
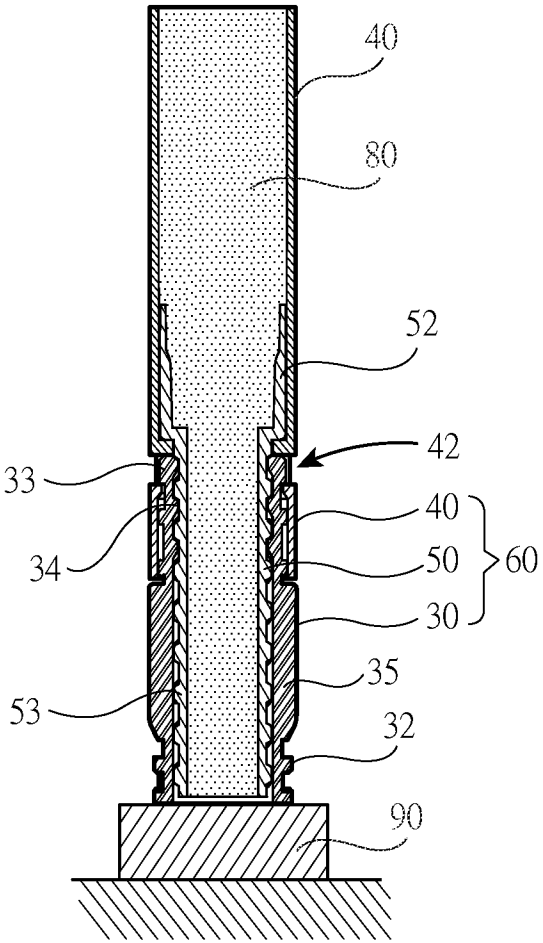
FIG. 9 schematically depicts hot filling the lipstick container when placed upwards is done.
Figure 8:
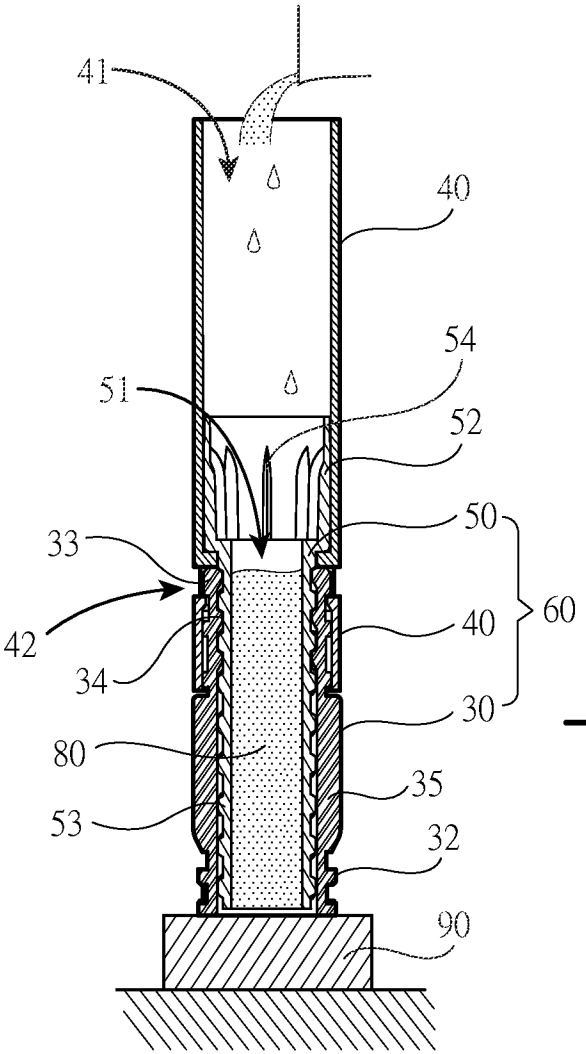
FIG. 8 schematically depicts hot filling the lipstick container when placed upwards.

Referring to FIGS. 8 to 9 and in conjugation with FIGS. 1 to 3, hot filling the lipstick container when placed upwards is shown. The spiral groove portion 53 of the ascending and descending tube 50 rotates along the internal threads 34 towards a bottom of the support tube 30, such that the ascending and descending tube 50 rotates towards the bottom. Next, a leakage proof member 90 is placed under the support tube 30. Then hot filling is poured into the fourth axial channel 51 of the ascending and descending tube 50 until the hot filling is filled to the top of the sleeving tube 40. When the hot filling is cooled down, the lipstick 80 is made.

Figure 11:
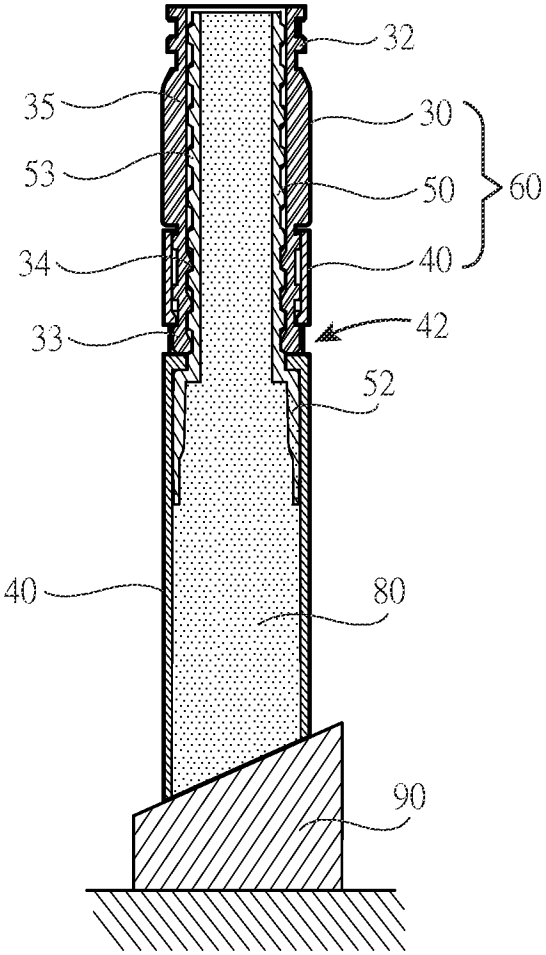
FIG. 11 schematically depicts hot filling the lipstick container when placed downwards is done.
Figure 10:
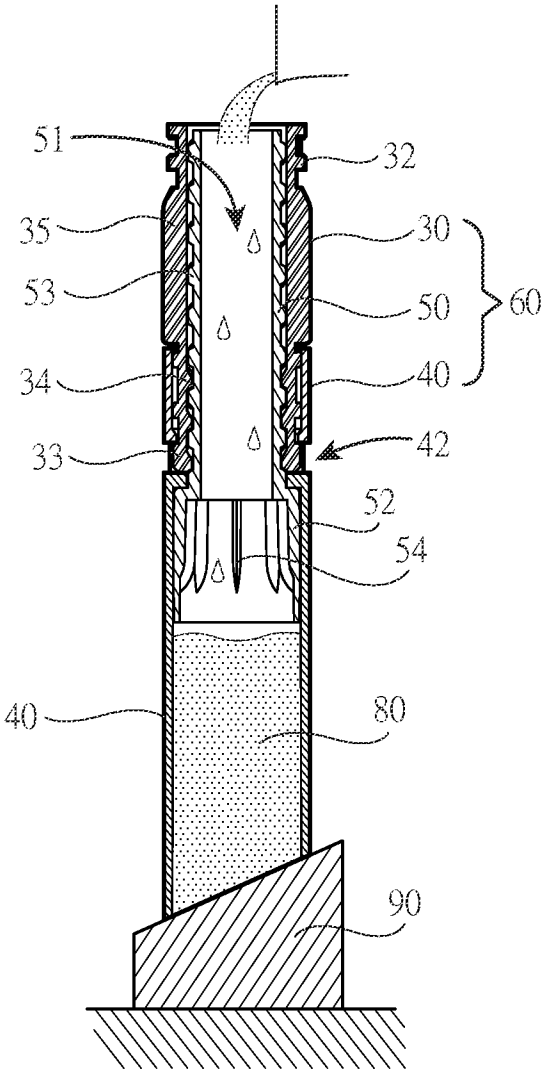
FIG. 10 schematically depicts hot filling the lipstick container when placed downwards.
Figure 14:
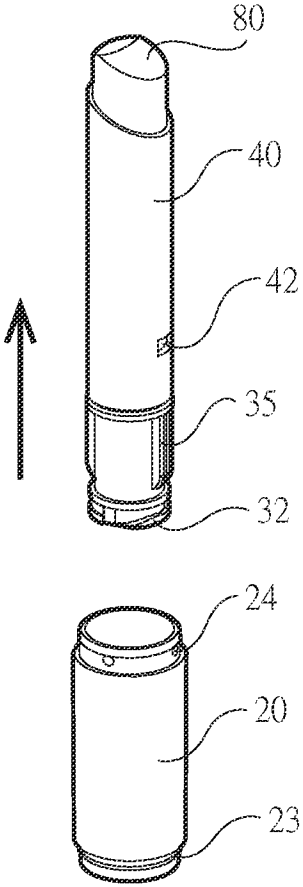
FIG. 14 schematically depicts the removal of the lipstick assembly form the fixed tube.
Figure 13:
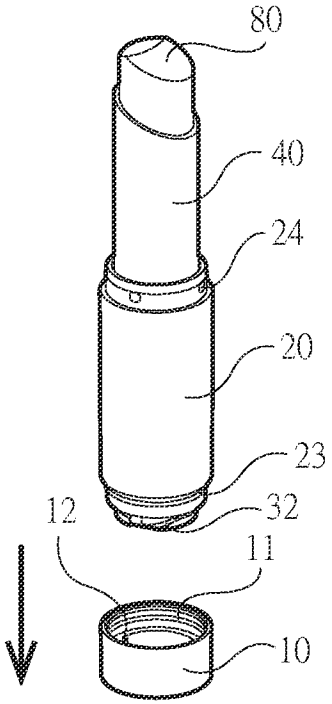
FIG. 13 schematically depicts a removal of the base.
Figure 12:
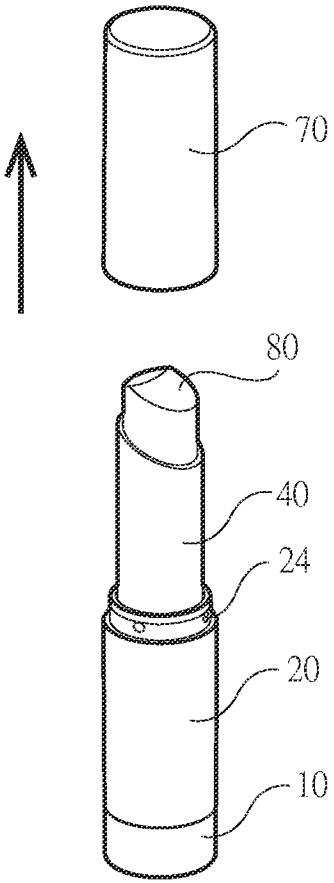
FIG. 12 schematically depicts a removal of the cap.
Figure 15:
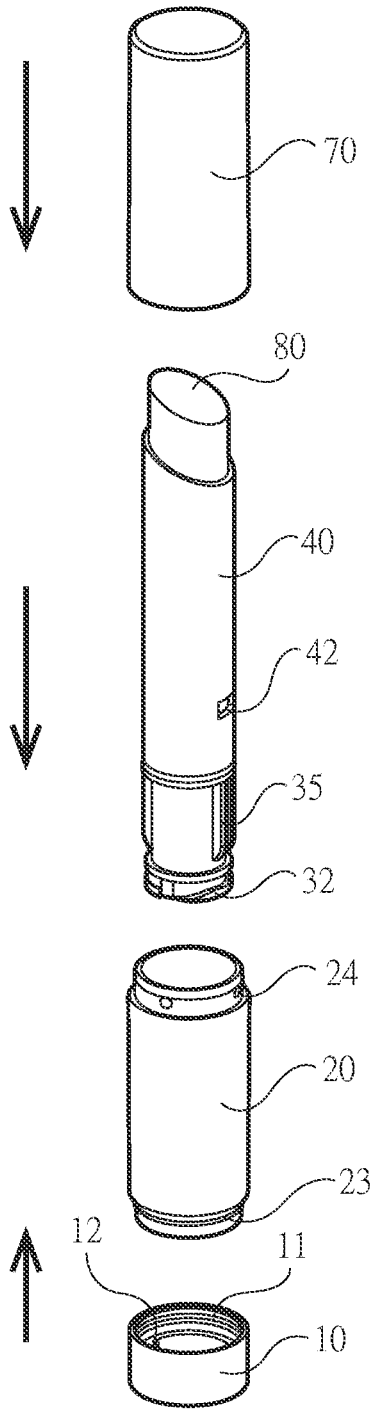
FIG. 15 schematically depicts assembling steps of replacing the new lipstick assembly.
Figure 16:
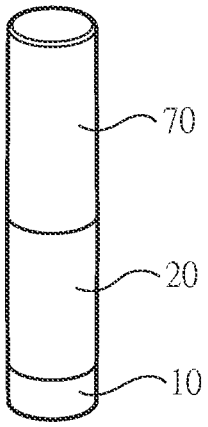
FIG. 16 is a perspective view of the assembled lipstick container.

Referring to FIGS. 10 to 11 and in conjugation with FIGS. 1 to 3, hot filling the lipstick container when placed downwards is shown. The spiral groove portion 53 of the ascending and descending tube 50 rotates along the internal threads 34 and towards an opposite direction of the top of the sleeving tube 40, such that the ascending and descending tube 50 rotates towards the bottom. Next, another leakage proof member 90 is placed under the sleeving tube 40. Then hot filling is poured into the fourth axial channel 51 of the ascending and descending tube 50 until the hot filling is filled to the top of the sleeving tube 40. When the hot filling is cooled down, the lipstick 80 is made.

Referring to FIGS. 12 to 16 and in accordance to FIG. 1, steps of replacing the lipstick assembly 60 is shown. When the lipstick 80 is consumed, remove the cap 70 and the base 10. Next, hold the fixed tube 20 to unscrew the support tube 30, and then the support tube 30, the sleeving tube 40 and the ascending and descending tube 50 can be removed to replace the new lipstick assembly 60. The base 10, the fixed tube 20 and the cap 70 can be reused. This not only protects the environment but also is eco-friendly with reduced waste.

While the invention has been described in terms of preferred embodiments, those skilled in the art will recognize that the invention can be practiced with modifications within the spirit and scope of the appended claims.

What is claimed is:

1. A lipstick container for hot filling with replaceable lipstick assembly comprising:

a base including a close end and an annular trough disposed on an inner surface of an open end distal the close end;

a fixed tube including a first axial channel disposed through a center of the fixed tube, an annular groove formed at an inner surface of a first end, an annular flange disposed on an outer surface of the first end, and the annular flange of the fixed tube secured with the annular trough of the base;

a lipstick assembly including a support tube, a sleeving tube and an ascending and descending tube;

wherein the support tube includes a second axial channel disposed through a center of the support tube, an annular protrusion formed at an outer surface of a first end of the support tube, internal threads formed at an inner surface of the first end, a plurality of ridges formed on the outer surface and at a middle portion of the support tube, and an annular shoulder disposed between the ridges and the annular protrusion, the fixed tube is put on the support tube, the ridges are mounted on the annular groove;

wherein the sleeving tube includes a third axial channel disposed through a center of the sleeving tube, a top of the sleeving tube being flat or inclined, a bottom of the sleeving tube being flat, and at least one locking hole formed through the sleeving tube, the fixed tube is put on the sleeving tube, the flat bottom of the sleeving tube urges against the annular shoulder of the support tube, the locking hole receives the annular protrusion of the support tube;

wherein the ascending and descending tube includes a fourth axial channel disposed through a center of the ascending and descending tube, a recess formed at a first end, a spiral groove portion communicates with the recess and extends from the recess towards a second end distal the recess, and a plurality of longitudinal ribs formed on an inner surface of the recess, the ascending and descending tube is disposed through the third axial channel of the sleeving tube and through the second axial channel of the support tube, the spiral groove portion is correspondently screwed with the internal threads of the support tube; and a cap including a close end and an open end, wherein the open end of the cap receives the sleeving tube and is secured to the fixed tube.

2. The lipstick container of claim 1, wherein the base further comprising a slip resistant member and a projecting member, the projecting member disposed between an outer surface of the slip resistant member and the inner surface of the base, external threads disposed on the support tube adjacent the base are screwed with the projecting member of the base.

3. The lipstick container of claim 1, wherein the sleeving tube further comprising an annular protuberance circulated along an inner surface of the sleeving tube, the annular protuberance urging against an end of the recess connected to the spiral groove portion.

4. The lipstick container of claim 1, wherein the ascending and descending tube further comprising a lipstick received in the recess and secured by the longitudinal ribs.

5. The lipstick container of claim 1, wherein the fixed tube further comprising a plurality of stubs on the outer surface distal the annular flange, and the cap further comprising an annular slot in an inner surface of the open end, the cap being put on the sleeving tube and secured to the fixed tube by the annular slot snapping the stubs.

* * * * *